US008834097B2

(12) United States Patent
Jewess et al.

(10) Patent No.: US 8,834,097 B2
(45) Date of Patent: Sep. 16, 2014

(54) COMPRESSOR DIFFUSER VANE DAMPER

(75) Inventors: Gordon F. Jewess, San Diego, CA (US); Ralph E. Gordon, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 901 days.

(21) Appl. No.: 12/797,079

(22) Filed: Jun. 9, 2010

(65) Prior Publication Data

US 2011/0302912 A1 Dec. 15, 2011

(51) Int. Cl.

| | |
|---|---|
| ***F04D 29/44*** | (2006.01) |
| ***F01D 25/06*** | (2006.01) |
| ***F01D 9/04*** | (2006.01) |
| ***F01D 17/16*** | (2006.01) |

(52) U.S. Cl.

CPC ..... *F01D 9/045* (2013.01); *F05D 2260/96* (2013.01); *F05D 2220/50* (2013.01); *F01D 25/06* (2013.01); *F01D 17/165* (2013.01)

USPC ..... 415/119

(58) Field of Classification Search

USPC ..... 415/119, 211.2, 208.1, 208.2, 208.3

See application file for complete search history.

(56) References Cited

U.S. PATENT DOCUMENTS

| | | | | |
|---|---|---|---|---|
| 3,778,184 | A * | 12/1973 | Wood | 415/209.4 |
| 3,957,392 | A * | 5/1976 | Blackburn | 415/146 |
| 5,235,803 | A | 8/1993 | Rodgers | |
| 5,611,664 | A * | 3/1997 | Haugen | 415/146 |
| 7,140,839 | B2 | 11/2006 | McAuliffe et al. | |
| 7,189,059 | B2 | 3/2007 | Barton et al. | |
| 7,322,202 | B2 | 1/2008 | Zywiak et al. | |
| 7,407,367 | B2 | 8/2008 | McAuliffe et al. | |
| 7,442,006 | B2 * | 10/2008 | Nguyen et al. | 415/208.4 |
| 7,722,316 | B2 * | 5/2010 | Scarinci et al. | 415/119 |
| 2002/0021962 | A1 * | 2/2002 | Nagata et al. | 415/203 |
| 2004/0062652 | A1 * | 4/2004 | Grant et al. | 416/220 R |
| 2005/0076650 | A1 * | 4/2005 | Dudebout et al. | 60/804 |
| 2005/0095127 | A1 | 5/2005 | Sasu et al. | |
| 2007/0196206 | A1 * | 8/2007 | Martin et al. | 415/191 |
| 2008/0056892 | A1 * | 3/2008 | Barton et al. | 415/191 |
| 2008/0193288 | A1 * | 8/2008 | Anschel et al. | 415/208.2 |
| 2009/0056892 | A1 | 3/2009 | Rekoske et al. | |
| 2009/0214331 | A1 | 8/2009 | Jewess et al. | |

OTHER PUBLICATIONS

Bryan et al. (Bryan, W.; Fleeter, S. "An Investigation of Unsteady Impeller-Diffuser Interactions in a Centrifugal Compressor". U.S. Army Aviation Systems Command, National Aeronautics and Space Administration NASA Lewis Research center, Nov. 1992).*

* cited by examiner

*Primary Examiner* — Liam McDowell

(74) *Attorney, Agent, or Firm* — Carlson, Gaskey & Olds, P.C.

(57) ABSTRACT

An auxiliary power unit is disclosed that includes a compressor section having a compressor inlet and a compressor exit. A turbine section is arranged downstream from the compressor exit. A diffuser is disposed in fluid communication with and between the compressor section and the turbine section. The diffuser has multiple generally radially extending circumferentially arranged vanes. A shroud housing is secured against the vanes. A damper is arranged between at least one vane and the shroud housing and configured to damp vibration of the at least one vane relative to the shroud housing during operation of the auxiliary power unit.

14 Claims, 2 Drawing Sheets

COMPRESSOR DIFFUSER VANE DAMPER

BACKGROUND

This disclosure relates to a compressor diffuser for use in an auxiliary power unit, for example. In particular, the disclosure relates to the interface between vanes of the diffuser and an adjacent shroud housing.

A typical auxiliary power unit utilizes a turbine section that receives compressed air from a compressor section to rotationally drive a component. In some auxiliary power units, a diffuser is arranged between the compressor section and the turbine section. In one type of diffuser, fixed radial vanes are arranged in a passage between a compressor exit and a turbine inlet. A shroud housing is bolted to the diffuser to seal the radial vanes against the shroud housing provide an air-tight passage.

SUMMARY

An auxiliary power unit is disclosed that includes a compressor section having a compressor inlet and a compressor exit. A turbine section is arranged downstream from the compressor exit. A diffuser is disposed in fluid communication with and between the compressor section and the turbine section. The diffuser has multiple generally radially extending circumferentially arranged vanes. A shroud housing is secured against the vanes. A damper is arranged between at least one vane and the shroud housing and configured to damp vibration of the at least one vane relative to the shroud housing during operation of the auxiliary power unit.

BRIEF DESCRIPTION OF THE DRAWINGS

The disclosure can be further understood by reference to the following detailed description when considered in connection with the accompanying drawings wherein.

DETAILED DESCRIPTION

Figure 1:
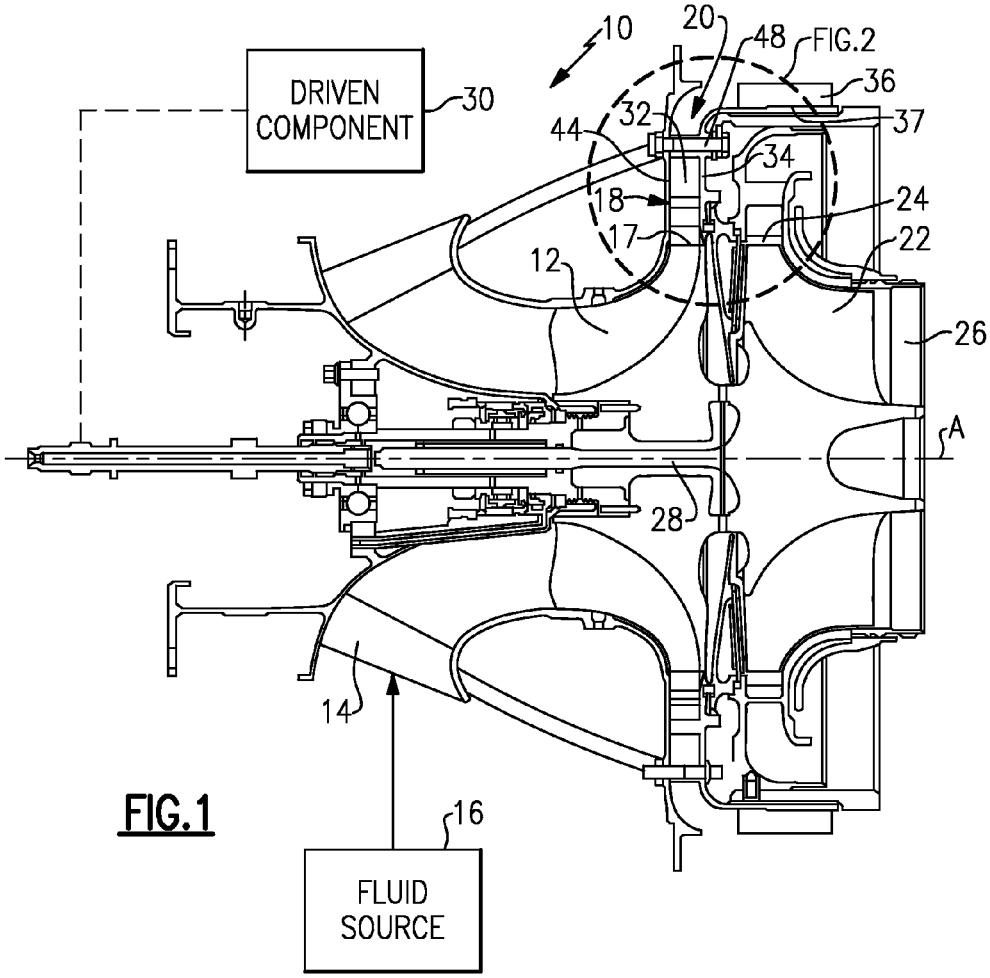
FIG. 1 is a partial cross-sectional view of an example auxiliary power unit.

An auxiliary power unit (APU) 10 is illustrated in FIG. 1. The APU 10 includes a compressor section 12 that receives fluid from a fluid source 16 through a compressor inlet 14. A diffuser 18 is arranged downstream from a compressor exit 17 of the compressor section 12. The diffuser 18 is used to regulate the output pressure from the compressor section 12 through a diffuser outlet 20.

A turbine section 22 receives the compressed, diffused fluid from the diffuser outlet 20 at a turbine inlet 24. A combustor (not shown) is provided between the diffuser outlet 20 and the turbine inlet 24 to provide a further heated fluid to the turbine section 22. Combusted, compressed fluid expands over the turbine section 22 rotationally driving an output shaft 28, about an axis A, that is operatively connected to the turbine section 22 and expelling the expanded fluid through a turbine outlet 26. The output shaft 28 rotationally drives a driven component 30.

The diffuser 18 is a fixed vane-type diffuser and is generally bowl-shaped. In the example, a plurality of circumferentially spaced radially extending vanes 32 (FIG. 3C) are integral with an annular base 34 of the diffuser 18. The vanes 32 include opposing sides 38 extending between leading and trailing ends 40, 42. Axially arranged vanes 36 are circumferentially spaced about an outer diameter 37 of the diffuser 18 and integrally formed with the base 34 in the example. By "integral" it is meant that the vanes 32, 36 cannot be removed by non-destructive means. In one example, the vanes 32, 36 are machined from base 34 and outer diameter 37, respectively, which may be provided by a forged or cast blank of titanium, Inconel or stainless steel, for example.

Figure 3B:
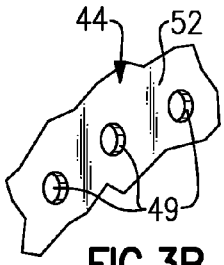
FIG. 3B is a broken partial perspective view of the shroud housing.
Figure 3C:
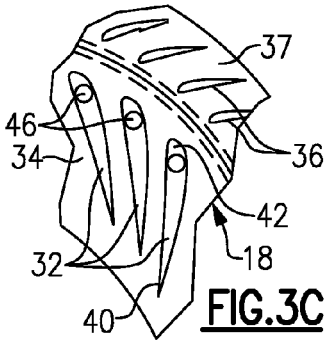
FIG. 3C is a broken partial perspective view of the vane on a diffuser.
Figure 2:
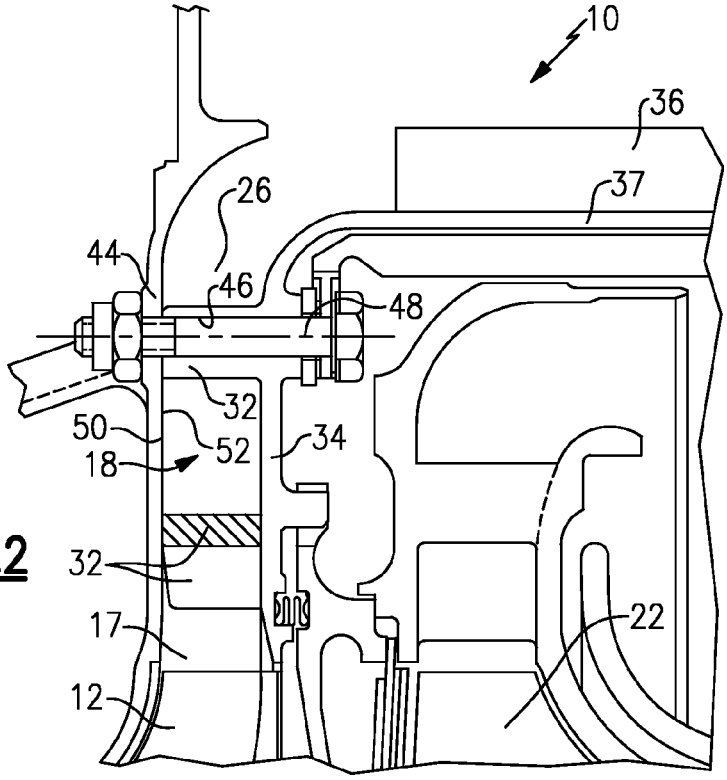
FIG. 2 is an enlarged view of an area indicated in FIG. 1.

Referring to FIG. 2, a shroud housing 44 is secured over the vanes 32 of the diffuser 18 to define the fluid passage from the exit 17 through the diffuser 18 to the turbine outlet 26. In the example, trailing ends 42 of the vanes 32 (FIGS. 3A and 3C) include holes 46 through which fasteners 48 are disposed to clamp the diffuser 18 to the shroud housing 44, which includes corresponding holes 49 (FIG. 3B). The fasteners 48 may be provided by a threaded fastener arrangement, as shown in FIGS. 1 and 2, or using non-threaded elements. It is desirable to seal and fully engage the vanes 32 to the shroud housing 44. There are thirty-five radial vanes 32 in one example diffuser 18, and it is difficult to securely clamp the shroud housing 44 over the vanes 32 such that the shroud surface 52 faces and uniformly engages each vane surface 50. As a result, the shroud housing 44 and vanes 32 may vibrate against one another resulting in portions of the vane 32, such as the leading end 40, to crack.

Figure 5:
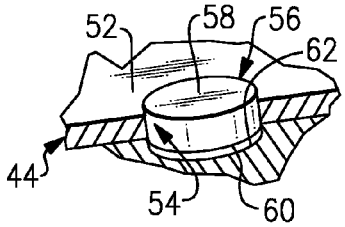
FIG. 5 is a partial cross-sectional view of a portion of the shroud housing with a diffuser vane damper.
Figure 3A:
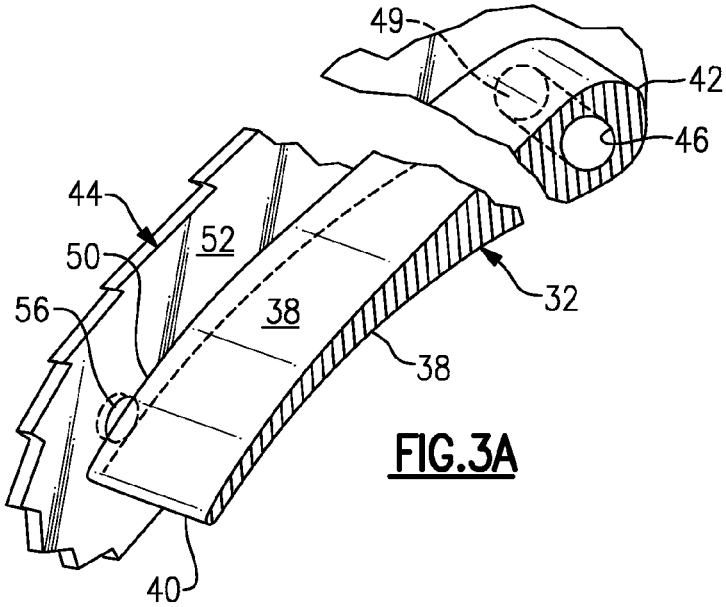
FIG. 3A is a broken partial cross-sectional view of a vane and a shroud housing.
Figure 4:
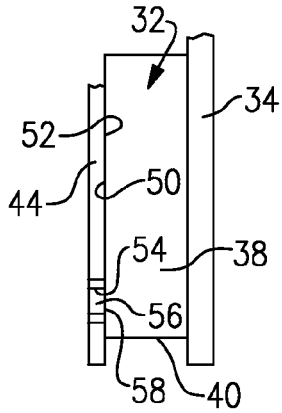
FIG. 4 is a side elevational view of a portion of the diffuser and vane in engagement with the shroud housing.

Referring to FIGS. 3A, 4 and 5, a damper 56 is provided between and aligned with the shroud housing 44 and the vane 32. In one example, a recess 54, which may be cylindrical in shape, is provided in the shroud housing 44 in an uncompressed condition. The damper 56, which may be a flexible polymeric material, such as silicone, is provided in the recess 54 such that an end 58 of the damper 56 is proud of the shroud surface 52. By "flexible" it is meant a material having a durometer of about 85-95 shore A. It should be understood that other flexible, heat-resistant damping materials may be used. The damper 56 is in a compressed condition with the shroud housing 44 secured to the diffuser 18 with the fasteners 48 in an assembled state. Thus, the leading ends 40 are prevented from vibrating against the shroud housing 44. An adhesive 60, such as glue, may be provided between the damper 56 opposite the end 58 and a bottom 62 of the recess 54 to retain the damper 56, which is in the uncompressed condition, securely within the recess 54 when in an unassembled state before and during assembly, as shown in FIG. 5.

Although an example embodiment has been disclosed, a worker of ordinary skill in this art would recognize that certain modifications would come within the scope of the claims. For that reason, the following claims should be studied to determine their true scope and content.

What is claimed is:

1. An auxiliary power unit comprising:

a compressor section having a compressor inlet and a compressor exit;

a turbine section arranged downstream from the compressor exit;

a diffuser disposed in fluid communication with and between the compressor section and the turbine section, the diffuser including multiple generally radially extending circumferentially arranged vanes;

a shroud housing secured against the vanes, wherein the vanes include a training end extending inwardly in a generally radial direction and tapering to a leading end; and a damper arranged between at least one vane and the shroud housing, the damper arranged at and engaging the leading end and configured to damp vibration of the at least one vane relative to the shroud housing.

2. The auxiliary power unit according to claim 1, wherein the diffuser includes an annular base with the vanes affixed to and integral with the annular base, the trailing end of a vane includes a hole aligned with a corresponding hole in the shroud housing, and a threaded fastener disposed in the holes and configured to clamp the diffuser and shroud housing to one another in an assembled state.

3. The auxiliary power unit according to claim 1, wherein each vane and the shroud housing each includes surfaces that face one another, and the damper includes a flexible polymeric material engaging a vane surface and a shroud housing surface.

4. The auxiliary power unit according to claim 2, wherein the damper includes a generally uncompressed condition in an unassembled state and a compressed condition in the assembled state, the shroud housing includes a recess aligned with the leading end, and the damper disposed in the recess, and an adhesive disposed in the recess between the damper and the shroud housing in the unassembled state.

5. The auxiliary power unit according to claim 1, wherein the damper includes a generally uncompressed condition in a unassembled state and a compressed condition in the assembled state, the shroud housing includes a recess aligned with a leading end of one of the vanes, and the damper disposed in the recess, and an adhesive disposed in the recess between the damper and the shroud housing in the unassembled state.

6. A diffuser assembly comprising:

a diffuser including multiple generally radially extending circumferentially arranged vanes, a shroud housing secured against the vanes, the shroud housing including a recess with a leading end of at least one of the vanes; and a damper arranged between at least one vane and the shroud housing, the damper engaging the leading end and configured to damp vibration of the at least one vane relative to the shroud housing, the damper disposed in the recess, and an adhesive disposed in the recess between the damper and the shroud housing.

7. The diffuser assembly according to claim 6, wherein each vane and the shroud housing each includes surfaces that face one another, and the damper includes a flexible material engaging a vane surface and a shroud housing surface.

8. The diffuser assembly according to claim 7, wherein the diffuser includes an annular base with the vanes affixed to and integral with the annular base.

9. The diffuser assembly according to claim 7, wherein the flexible material is a polymeric material.

10. The diffuser assembly according to claim 6, wherein the trailing end of a vane includes a hole aligned with a corresponding hole in the shroud housing, and a threaded fastener disposed in the holes and configured to clamp the diffuser and shroud housing to one another in an assembled state.

11. The diffuser assembly according to clam 10, wherein the damper includes a generally uncompressed condition in an unassembled state and a compressed condition in the assembled state.

12. A shroud housing comprising:

a shroud housing including a surface configured to engage a diffuser vane, and a recess provided in the surface, the surface including a hole configured to receive a fastener for securing the shroud housing to a diffuser; and a solid damper including a flexible material disposed in the recess, the flexible material comprising a polymeric material, and the damper and the recess are remote from the hole and the fastener.

13. A diffuser assembly comprising:

a diffuser including multiple generally radially extending circumferentially arranged vanes;

a shroud housing secured against the vanes by at least one fastener; and a damper arranged between at least one vane and the shroud housing and configured to damp vibration of the at least one vane relative to the shroud housing, wherein the diffuser includes an annular base with the vanes affixed to and integral with the annular base.

14. A diffuser assembly comprising:

a diffuser including multiple generally radially extending circumferentially arranged vanes;

a shroud housing secured against the vanes by at least one fastener;

a damper arranged between at least one vane and the shroud housing and configured to damp vibration of the at least one vane relative to the shroud housing; and an adhesive disposed in the recess between the damper and the shroud housing in the unassembled state.

* * * * *